US005915826A

United States Patent [19]

Lin

[11] Patent Number: 5,915,826

[45] Date of Patent: Jun. 29, 1999

[54] DECORATION LAMP DEVICE

[76] Inventor: Mei-Lu Lin, 56, Minsheng Street, Fengyuan, Taichung Hsen 420, Taiwan

[21] Appl. No.: 09/042,678

[22] Filed: Mar. 15, 1998

[51] Int. Cl.[6] ..... H01R 33/00

[52] U.S. Cl. ..... 362/226; 362/396; 362/806; 439/699.2

[58] Field of Search ..... 362/123, 226, 362/249, 252, 391, 396, 806; 439/699.2, 457

[56] References Cited

U.S. PATENT DOCUMENTS 5,697,698 12/1997 Huang ..... 362/226
5,829,865 11/1998 Ahroni ..... 362/249

*Primary Examiner*—Y. Quach

[57] ABSTRACT

A decoration lamp device has a lamp holder, a socket receiving the lamp holder, a bulb dispopsed on the lamp holder, and a base plug disposed on a bottom of the socket. The lamp holder has a bottom notch and two copper threads. The socket has two opposite inner walls. Each inner wall has a recess, a bottom protrusion, a groove, and a channel communicating with the groove. The base plug has a separation plate, two hook lugs, and two blocks. A connection portion is disposed between the separation plate and the respective hook lug. Each hook lug has an opening. Each block has a slot. Two electric wires are inserted in the socket. Each electric wire is connected to a conductive plate. Each conductive plate is inserted in the respective recess. Each copper thread contacts the respective conductive plate. The separation plate is inserted in the grooves. Each connection portion is inserted in the respective channel.

2 Claims, 5 Drawing Sheets

DECORATION LAMP DEVICE

BACKGROUND OF THE INVENTION

This invention relates to a decoration lamp device, and more particularly, this invention relates to a decoration lamp device which contains a specific base plug.

Referring to FIG. 1, a conventional decoration lamp device (as shown in U.S. Pat. No. 5,707,138) has a lamp holder 1, a socket 3 receiving the lamp holder 1, and a bulb 2 dispopsed on the lamp holder 1. The lamp holder 1 has a bottom notch 12 and two copper threads 21. The socket 3 has a hollow interior 31 and a separation plate 32 disposed in the hollow interior 31. A groove 11 is formed on the lamp holder 1 to drain water.

SUMMARY OF THE INVENTION

An object of the invention is to provide a lamp device which contains a specific base plug to position wires stably.

Accordingly, a decoration lamp device comprises a lamp holder, a socket receiving the lamp holder, a bulb dispopsed on the lamp holder, and a base plug disposed on a bottom of the socket. The lamp holder has a bottom notch and two copper threads. The socket has two opposite inner walls. Each of the inner walls has a recess, a bottom protrusion, a groove, and a channel communicating with the groove. The base plug has a separation plate, two hook lugs, and two blocks. A connection portion is disposed between the separation plate and the respective hook lug. Each of the hook lugs has an opening. Each of the blocks has a slot. Two electric wires are inserted in the socket. Each of the electric wires is connected to a conductive plate. Each of the conductive plates is inserted in the respective recess. Each of the copper threads contacts the respective conductive plate. The separation plate is inserted in the grooves. Each connection portion is inserted in the respective channel. An upper end of the separation plate is inserted in the bottom notch. Each of the hook lug positions the respective electric wire stably.

DETAILED DESCRIPTION OF THE INVENTION

Figure 1:
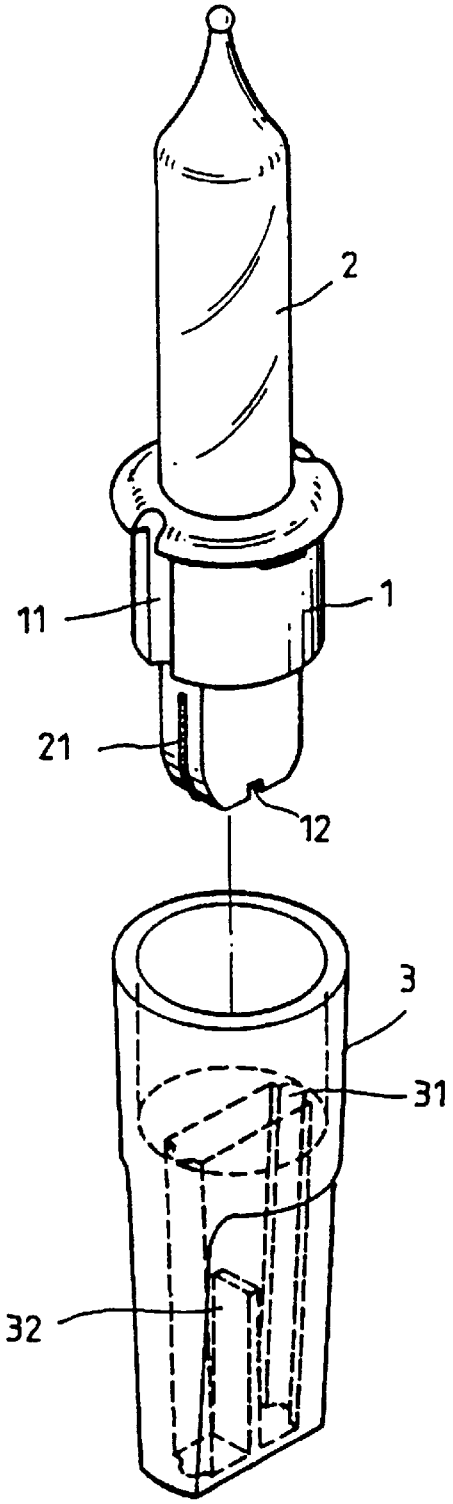
FIG. 1 PRIOR ART
FIG. 1 is a perspective exploded view of a decoration lamp device of the prior art.
Figure 2:
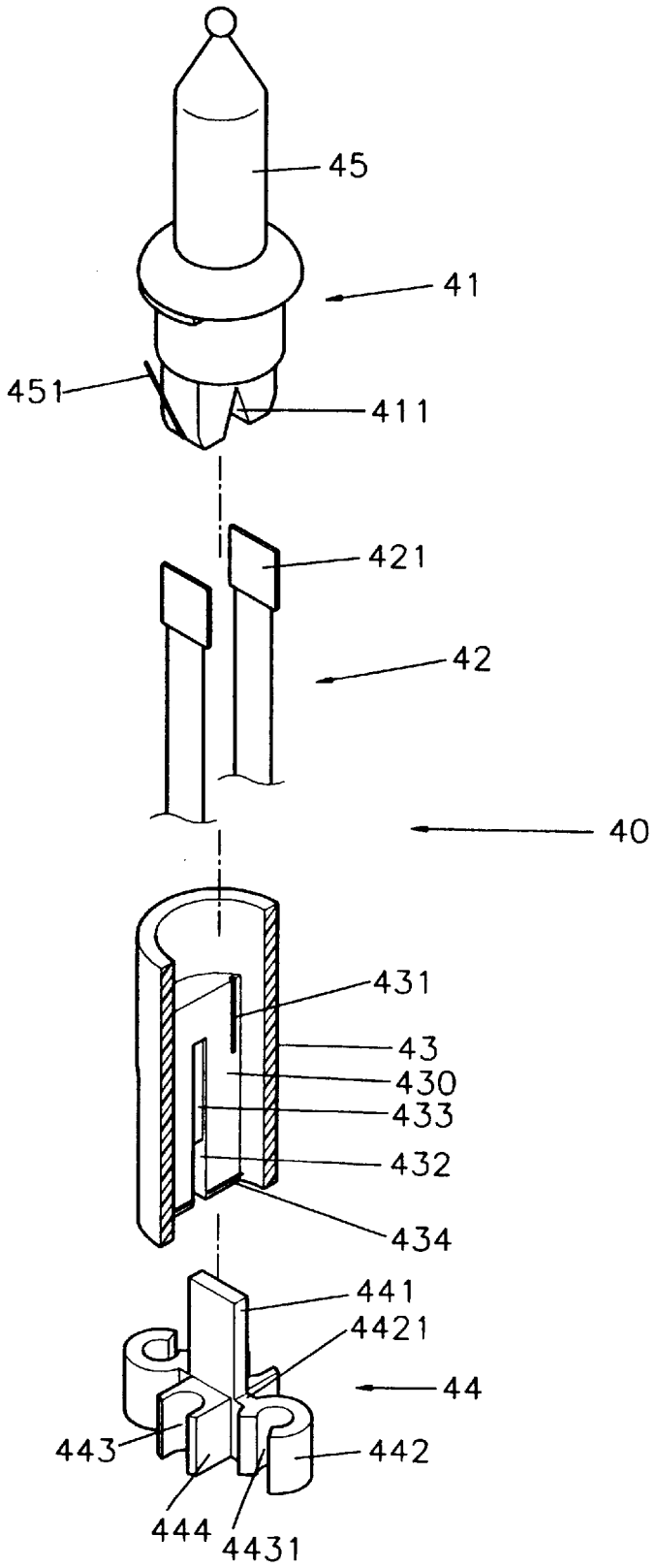
FIG. 2 is a perspective exploded view of a decoration lamp device of a preferred embodiment in accordance with this invention.
Figure 3:
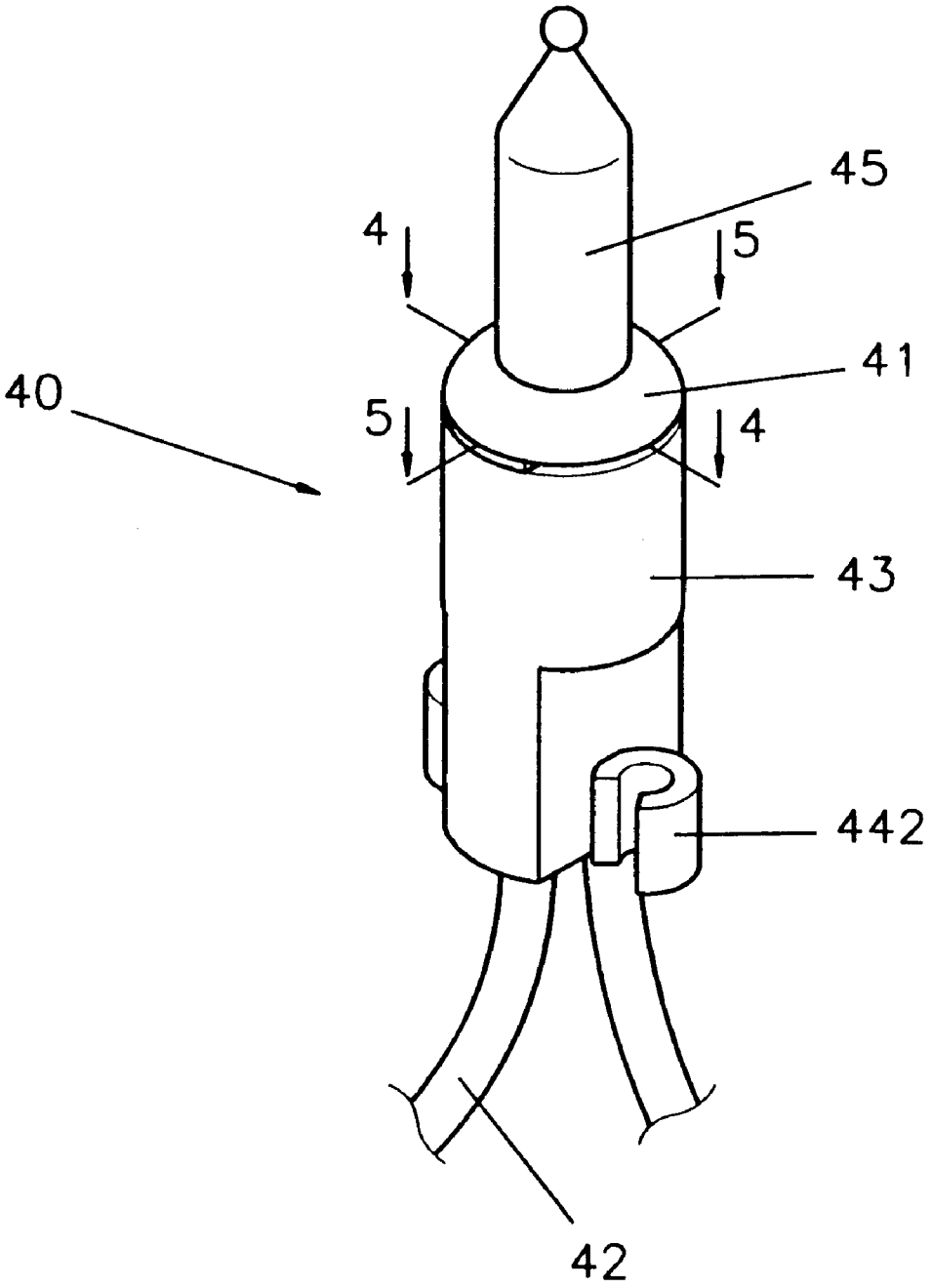
FIG. 3 is a perspective assembly view of a decoration lamp device of a preferred embodiment in accordance with this invention.
Figure 4:
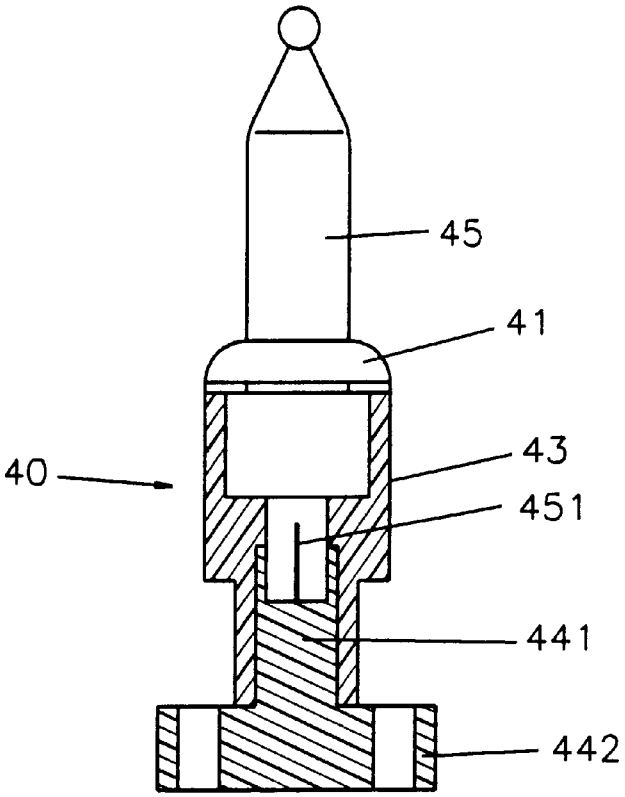
FIG. 4 is a sectional view taken along line 4—4 in FIG. 3.
Figure 5:
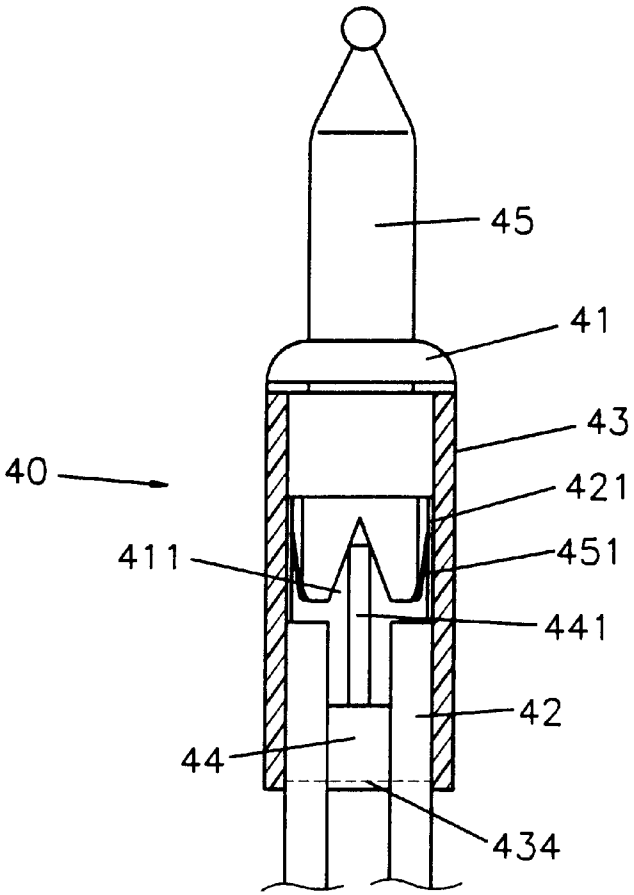
FIG. 5 is a sectional view taken along line 5—5 in FIG. 3.
Figure 6:
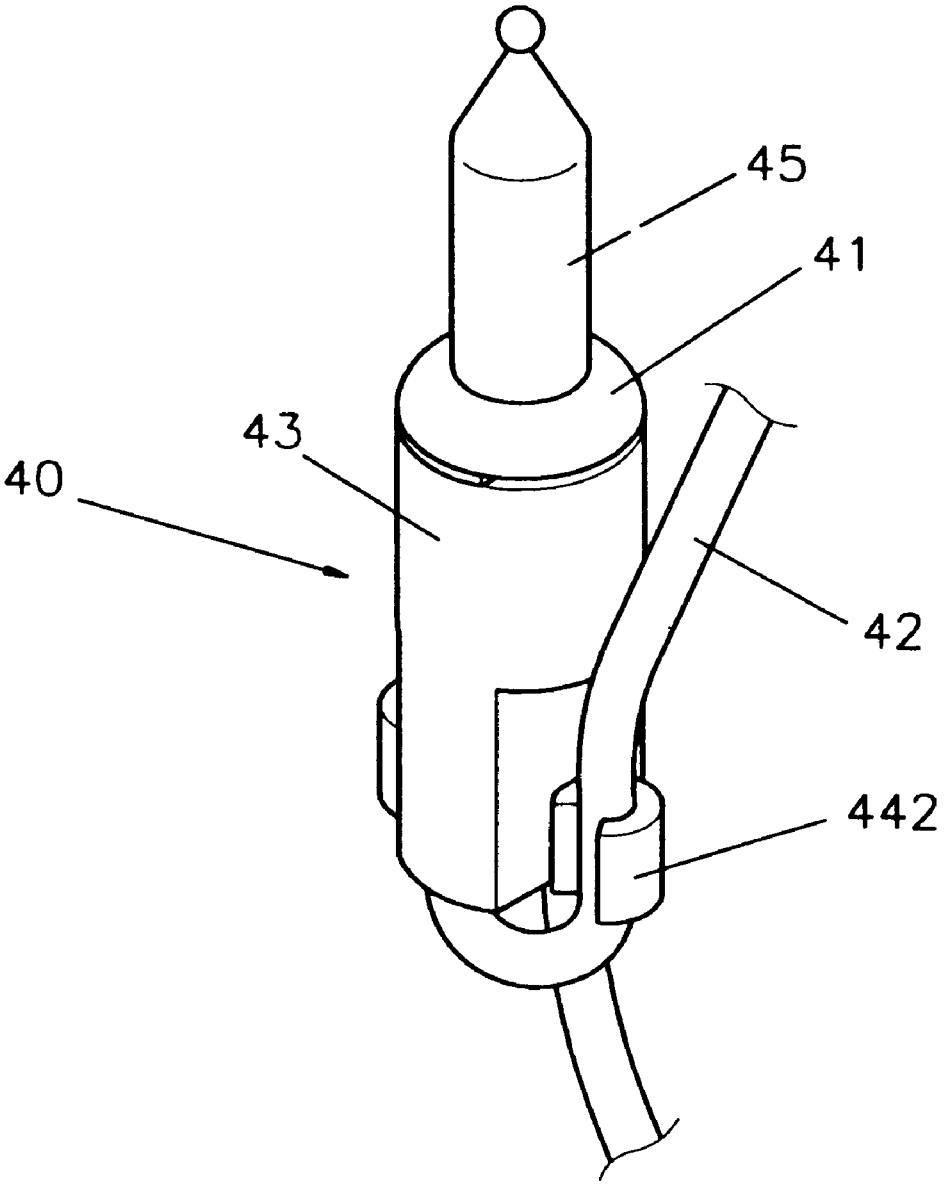
FIG. 6 is a schematic view illustrating an application of a decoration lamp device of a preferred embodiment in accordance with this invention.

Referring to FIGS. 2 to 6, a decoration lamp device 40 comprises a lamp holder 41, a socket 43 receiving the lamp holder 41, a bulb 45 dispopsed on the lamp holder 41, and a base plug 44 disposed on a bottom of the socket 43. The lamp holder 41 has a bottom notch 411 and two copper threads 451. The socket 43 has two opposite inner walls 430. Each of the inner walls 430 has a recess 431, a bottom protrusion 434, a groove 433, and a channel 432 communicating with the groove 433. The base plug 44 has a separation plate 441, two hook lugs 442, and two blocks 444. A connection portion 4421 is disposed between the separation plate 441 and the respective hook lug 442. Each of the hook lugs 442 has an opening 4431. Each of the blocks 444 has a slot 443. The bottom notch 411 is in a triangular shape. Two electric wires 42 are inserted in the socket 43. Each of the electric wires 42 is connected to a conductive plate 421. Each of the conductive plates 421 is inserted in the respective recess 431. Each of the copper threads 451 contacts the respective conductive plate 421. The separation plate 441 is inserted in the grooves 433. Each connection portion 4421 is inserted in the respective channel 432. An upper end of the separation plate 441 is inserted in the bottom notch 411.

Each of the hook lug 442 positions the respective electric wire 42 stably.

I claim:

1. A decoration lamp device comprises:

a lamp holder, a socket receiving the lamp holder, a bulb dispopsed on the lamp holder, a base plug disposed on a bottom of the socket, the lamp holder having a bottom notch and two copper threads, the socket having two opposite inner walls, each of the inner walls having a recess, a bottom protrusion, a groove, and a channel communicating with the groove, the base plug having a separation plate, two hook lugs, and two blocks, a connection portion disposed between the separation plate and the respective hook lug, each of the hook lugs having an opening, each of the blocks having a slot, two electric wires inserted in the socket, each of the electric wires connected to a conductive plate, each of the conductive plates inserted in the respective recess, each of the copper threads contacting the respective conductive plate, the separation plate inserted in the grooves, each connection portion inserted in the respective channel, and an upper end of the separation plate inserted in the bottom notch.

2. A decoration lamp device as claimed in claim 1, wherein the bottom notch is in a triangular shape.

* * * * *